US011808053B2

(12) United States Patent
Huang

(10) Patent No.: US 11,808,053 B2
(45) Date of Patent: Nov. 7, 2023

(54) INFLATABLE POOL

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 81 days.

(21) Appl. No.: 17/592,176

(22) Filed: Feb. 3, 2022

(65) Prior Publication Data

US 2022/0251860 A1 Aug. 11, 2022

(30) Foreign Application Priority Data

Feb. 9, 2021 (CN) ..... 202120363917.3

(51) Int. Cl.
*E04H 4/00* (2006.01)

(52) U.S. Cl.
CPC ..... *E04H 4/0025* (2013.01)

(58) Field of Classification Search
CPC ..... E04H 4/0025; E04H 4/1245
USPC ..... 4/488, 506
See application file for complete search history.

(56) References Cited

U.S. PATENT DOCUMENTS 6,357,059 B1 * 3/2002 Lau ..... E04H 4/0025 4/506
2005/0000567 A1 * 1/2005 Wu ..... E04H 4/0025 137/223
2015/0020306 A1 * 1/2015 Lin ..... E04H 4/0025 4/585
2019/0032351 A1 1/2019 Huang et al.
2020/0407992 A1 12/2020 Lin et al.

FOREIGN PATENT DOCUMENTS

CN 203654813 6/2014
EP 1138307 10/2001

OTHER PUBLICATIONS

Extended European Search Report, dated Jul. 11, 2022 (Jul. 11, 2022), issued on related European Patent Application 22155702.8 by the European Patent Office.

* cited by examiner

*Primary Examiner* — Tuan N Nguyen
(74) *Attorney, Agent, or Firm* — DICKINSON WRIGHT PLLC

(57) ABSTRACT

An inflatable pool is provided, including an inflatable pool body including an inner wall, an outer wall and a bottom wall. The inner wall and the bottom wall define a water storage space, the inner wall and the outer wall form an inflatable chamber, and a cavity is defined between the inner wall and the outer wall. The inflatable pool further includes a pump device; a pool body connecting pipe including an inner end in communication with the water storage space and an outer end disposed within the cavity; and a pump connecting pipe including an outer end connected to the pump device, and an inner end including a connector detachably connected to the outer end of the pool body connecting pipe. A junction between the pool body connecting pipe and the pump connecting pipe is disposed within the cavity.

8 Claims, 7 Drawing Sheets

INFLATABLE POOL

CROSS-REFERENCE TO RELATED APPLICATION

This Application claims priority from Chinese Application CN202120363917.3, filed Feb. 9, 2021 in China, the disclosure of which is incorporated herein by reference in its entirety.

BACKGROUND

1. Field

Apparatuses and methods consistent with exemplary embodiments relate to ground pool technology, and in particular to an inflatable pool comprising an inflatable pool body and a pump device.

2. Description of the Related Art

An inflatable pool often comprises an inflatable pool body and a pump device. A pump device may be an external pump device or a built-in pump device, depending on its arrangement. An external pump device is located outside the inflatable pool body, and a built-in pump device is located between an inner wall and an outer wall of the inflatable pool body. Because an inflatable pool with an external pump device has an inflatable pool body and a pump device which is easily removed, after-sales maintenance is facilitated, and the pool has a low maintenance cost.

In an inflatable pool with an external pump device, the pump device is spaced apart from the outer wall of the inflatable pool body for the purpose of reserving a space for a user to connect the inflatable pool body to the pump device. A pool body connecting pipe is connected to the inflatable pool body; the pool body connecting pipe passes through the inner wall and the outer wall of the pool body; and a pump connecting pipe is connected to the pump device. An inflatable pool with the external pump device is assembled by first inflating the inflatable pool body and then connecting the pool body connecting pipe to the pump connecting pipe. However, an inflatable pool connected in this way covers a large area, and the pool body connecting pipe and the pump connecting pipe are partially exposed, which affects the pool's overall appearance. In addition, a control panel of the pump device is spaced apart from the inflatable pool body, resulting in inconvenience in operating the control panel during use.

SUMMARY

Example embodiments may address at least the above problems and/or disadvantages and other disadvantages not described above. Also, example embodiments are not required to overcome the disadvantages described above, and may not overcome any of the problems described above.

One or more example embodiments may provide an inflatable pool with an external pump device, which covers a small area and facilitates operation.

According to an aspect of an example embodiment, an inflatable pool comprises: an inflatable pool body comprising: an inner wall, an outer wall, and a bottom wall, the inner wall and the bottom wall defining a water storage space, and the inner wall and the outer wall forming an inflatable chamber therebetween, wherein a cavity is defined between the inner wall and the outer wall; a pump device; wherein a part of the outer wall of the inflatable pool body is recessed inward and is connected to the inner wall to form a cavity; a pool body connecting pipe comprising an inner end in communication with the water storage space and an outer end disposed within the cavity; and a pump connecting pipe comprising an outer end connected to the pump device, and an inner end comprising a connector detachably connected to the outer end of the pool body connecting pipe; wherein a junction between the pool body connecting pipe and the pump connecting pipe is disposed within the cavity.

The inflatable pool may further comprise: a pipe connector connected between the outer end of the pool body connecting pipe and the connector of the pump connecting pipe; wherein the inner end of the pool body connecting pipe is connected to the inner wall of the inflatable pool body and in communication with the water storage space via a pipe socket.

The pipe socket may comprise: an inner pipe socket, an outer pipe socket, and a circumferential flexible gasket disposed between the inner pipe socket and the outer pipe socket and sealed to the inner wall of the inflatable pool body, wherein the outer pipe socket is disposed within the cavity and comprises: a plug-in portion comprising an annular plug-in groove fitting the pool body connecting pipe therein, and a locking portion engaged with an outer periphery of the plug-in portion.

The inner pipe socket may comprise an engaging portion disposed within the water storage space.

The plug-in portion of the outer pipe socket may comprise: an annular inner flange comprising, on a periphery thereof, a first external thread configured to engage with a first internal thread disposed on the locking portion; and an annular outer flange; being formed between the inner flange and the outer flange.

An inner end of the locking portion may comprise an inwardly extending lip.

The inner end of the pool body connecting pipe may be connected to the pipe socket, and the outer end of the pool body connecting pipe is inserted into the connector end of the pump connecting pipe and sealed by a seal ring; and the pipe connector may be configured to be sleeved on the outer periphery of the outer end of the pool body connecting pipe, the outer periphery of the outer end of the pool body connecting pipe comprising a first limiting portion configured to restrict movement of the pipe connector.

An inner diameter of the inner end of the pipe connector may be less than an inner diameter of the outer end of the pipe connector.

The connector of the inner end of the pump connecting pipe may be inserted between an inner circumferential surface of the outer end of the pipe connector and an outer circumferential surface of the outer end of the pool body connecting pipe, and at least part of the inner surface circumferential of the pipe connector may comprise a second internal thread, and the outer circumferential surface of the connector of the pump connecting pipe may comprise a second external thread configured to engage with the second internal thread.

The pool body connecting pipe may further comprise a second limiting portion configured to restrict movement of the pipe connector, the second limiting portion being separable from the pool body connecting pipe.

The pump device may comprise a control panel disposed on the housing; the pump connecting pipe may extend into the housing of the pump device and comprises, within the housing of the pump device, a water inlet pipe, and a water outlet pipe; and the pump device may further comprise a filter pump and a heater sequentially arranged between an outlet of the water inlet pipe and an inlet of the water outlet pipe.

The cavity comprises a first cavity and a second cavity.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
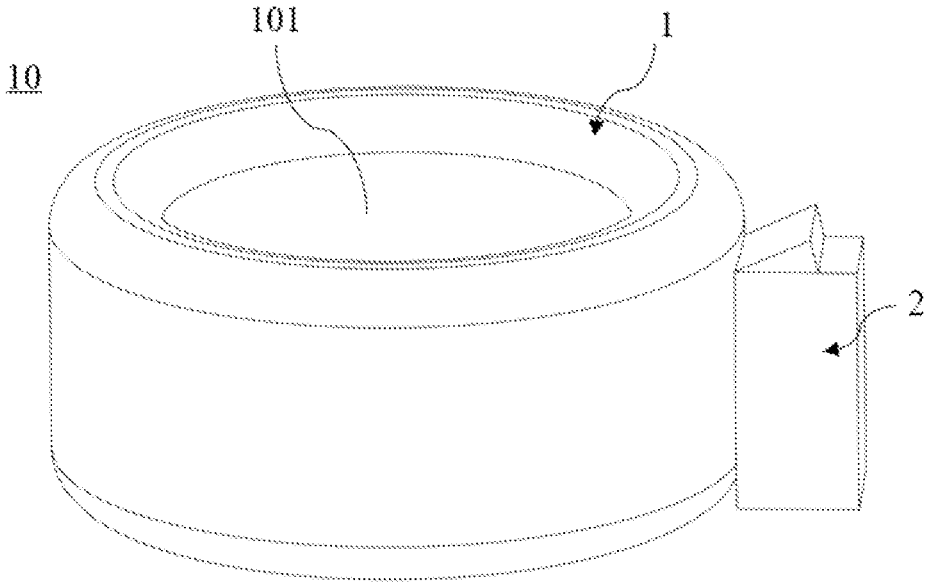
FIG. 1 is a perspective schematic view of an inflatable pool comprising an inflatable pool body and a pump device, according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

Expressions of relational orientation, such as "upper," "lower," "inside," "outside," etc. which are used for explaining the structural positions of various components as described herein, are not absolute but relative. The orientation expressions are appropriate when the various components are arranged as shown in the figures, but should change accordingly when the positions of the various components in the figures change.

In this description, position terms such as "upper," "lower," "inside," and "outside" are defined according to the position of a ground pool during normal use.

In this description, the term "communication" refers to fluid communication, that is, water and gas can be transferred between two components in communication with each other.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

Figure 2A:
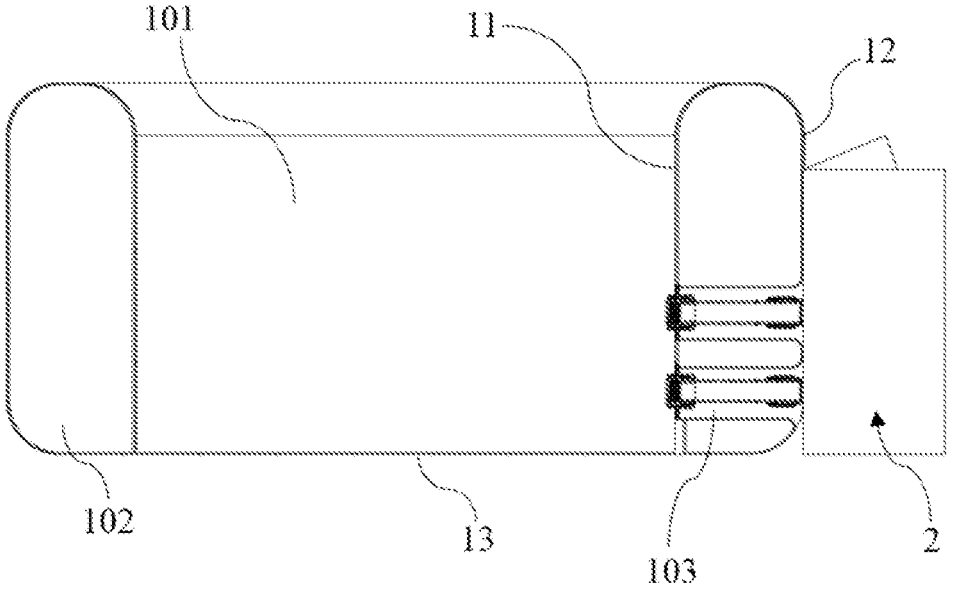
FIG. 2*a* is a cross-sectional schematic diagram of the inflatable pool shown in FIG. 1, according to an example aspect.
Figure 2B:
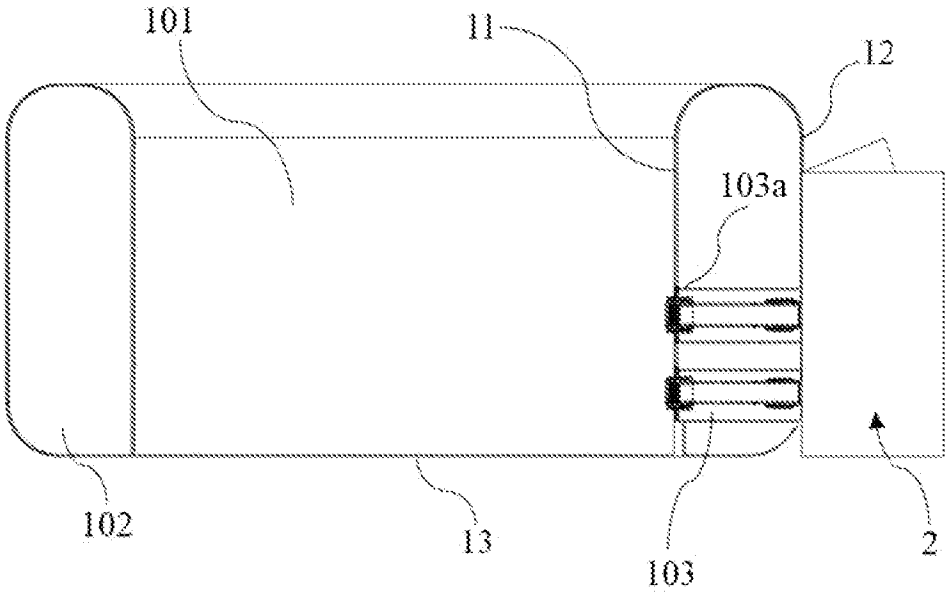
FIG. 2*b* is a cross-sectional schematic diagram of the inflatable pool shown in FIG. 1, according to another example aspect.
Figure 3A:
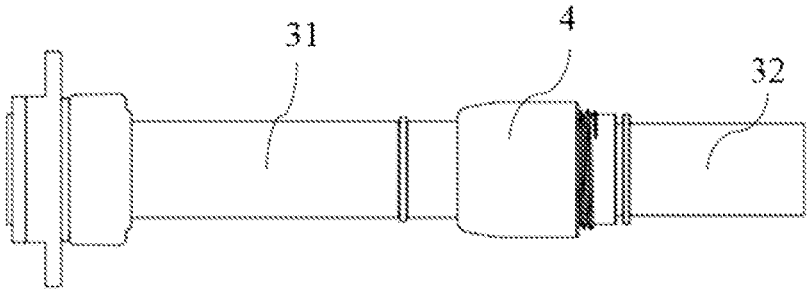
FIG. 3*a* is a schematic diagram of various connecting pipes in a connected state, according to an example embodiment.
Figure 3B:
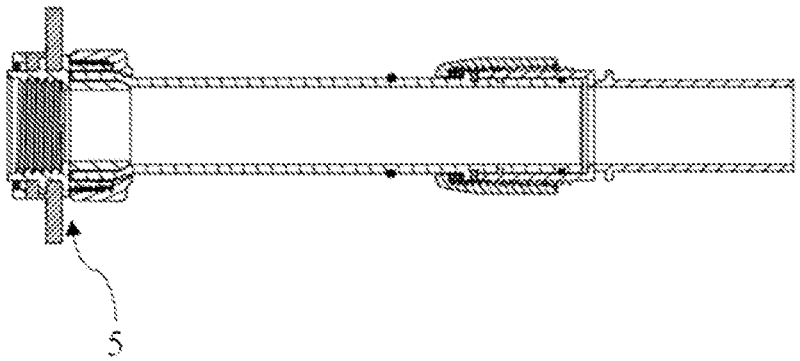
FIG. 3*b* shows a cross-sectional schematic diagram of the connecting pipes of FIG. 3*a;*
Figure 4B:
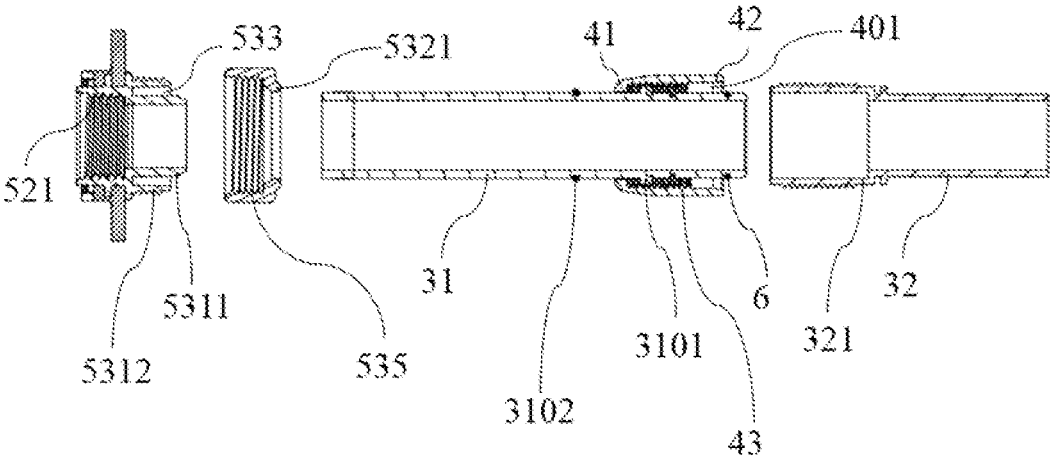
FIG. 4*b* shows a cross-sectional schematic diagram of the various connecting pipes of FIG. 4*a;*
Figure 5:
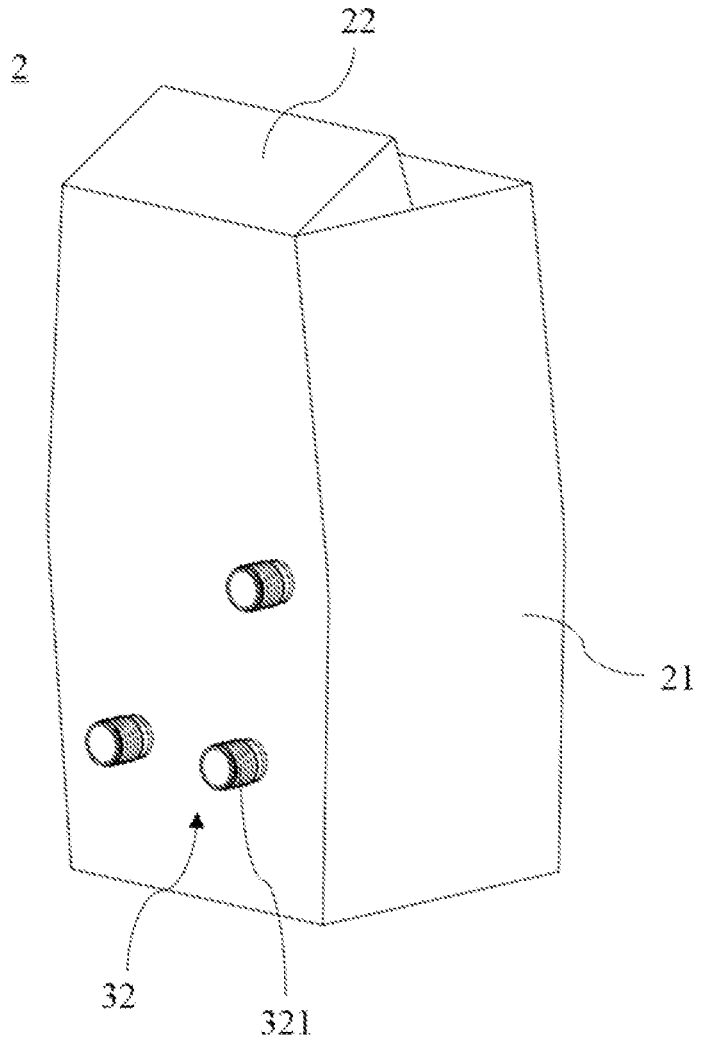
FIG. 5 is a perspective schematic view of a pump device, according to an example embodiment.

With reference to FIGS. 1, 2*a*, and 2*b*, an inflatable pool 10 is a ground pool which comprises an inflatable pool body 1 and a pump device 2 having a housing 21 (FIG. 5). The inflatable pool body 1 comprises an inner wall 11, an outer wall 12, and a bottom wall 13, wherein the inner wall 11 and the bottom wall 13 define a water storage space 101, and an annular inflatable chamber 102 of the inflatable pool 10 is defined between the inner wall 11 and the outer wall 12. A diaphragm structure (not shown) may be arranged within the inflatable chamber 102, and may be connected between the inner wall 11 and the outer wall 12 of the inflatable pool body 1. Such a diaphragm structure may be is configured to limit an excessive expansion of the inflatable chamber when the inflation chamber 102 is inflated, and to keep the structure stable. As shown in FIGS. 2*a* and 2*b*, the pump device 2 is an external pump device which is in communication with the water storage space 101 of the inflatable pool body 1 and is configured to process water from the water storage space 101. As shown in FIGS. 3*a* and 3*b*, a pool body connecting pipe 31 is connected to the inflatable pool body 1, a pump connecting pipe 32, comprising a connector end 321 (FIG. 4*b*) is connected to the pump device 2, and the inflatable pool body 1 is connected to the pump device 2 by means of the pool body connecting pipe 31 and the pump connecting pipe 32.

Figure 7:
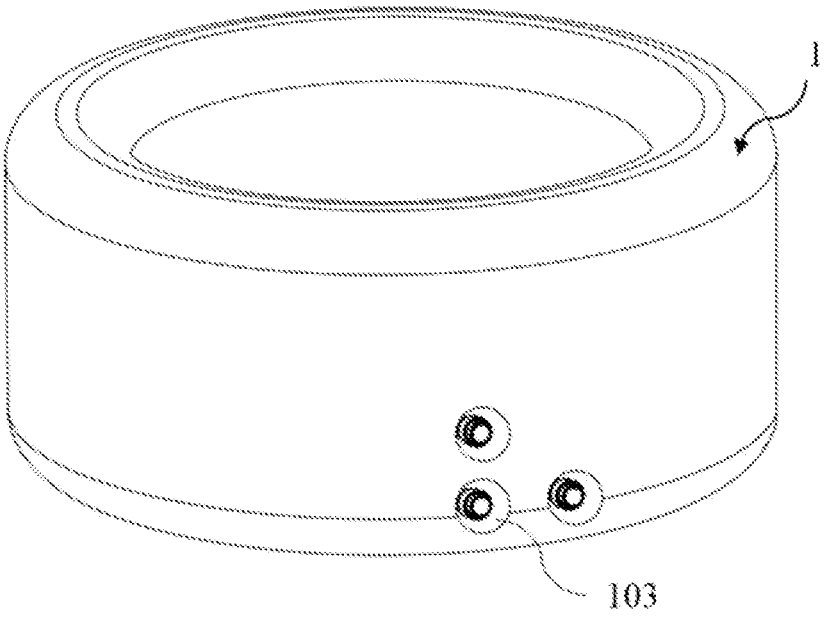
FIG. 7 is a perspective schematic view of an inflatable pool body of an inflatable pool according to an example embodiment.

As shown in FIG. 2*a*, in combination with FIGS. 5 and 7, a cavity 103 may be formed when a part of the outer wall 12 of the inflatable pool body 1 is recessed inward and is connected to the inner wall 11. As shown in FIG. 2*b*, according to another example aspect, the cavity 103 may be defined by one or more sleeves 103*a*, where one end of each sleeve is connected, for example by welding, to the inner wall 11, and another end of each sleeve is connected to the outer wall 12. Before the pool body connecting pipe 31 is connected to the pump connecting pipe 32, the pool body connecting pipe 31 is located in the cavity 103, and the connector end 321 of the pump connecting pipe 32 protrudes from the housing 21, and after the pool body connecting pipe 31 is connected to the pump connecting pipe 32 and the inflatable pool body 1 is inflated, the junction between the pool body connecting pipe 31 and the pump connecting pipe 32 is also located in the cavity 103. In other words, as shown in FIGS. 1, 2*a*, and 2*b*, after inflation of the inflatable pool 10, the pump device 2 abuts against the outer wall 12 of the inflatable pool body 1, or there is no significant gap between the pump device 2 and the outer wall 12 of the inflatable pool body 1. Therefore, a coverage area of the inflatable pool 10 comprising the external pump device 2 may be reduced, connecting pipelines may be hidden, and the overall aesthetics may be enhanced.

The pool body connecting pipe 31 and the pump connecting pipe 32 will be described in detail below.

As shown in FIGS. 3*a* to 3*b* and FIGS. 4*a* to 4*b*, the pool body connecting pipe 31 is connected to the connector end 321 of the pump connecting pipe 32 via a pipe connector 4, and the pool body connecting pipe 31 is connected to the inner wall 11 of the inflatable pool body 1 and in communication with the water storage space 101 via a pipe socket 5.

In particular, the pipe socket 5 comprises a circumferential flexible gasket 51, and an inner pipe socket 52 and an outer pipe socket 53 separated by the circumferential flexible gasket 51. That is, the inner pipe socket 52 and the outer pipe socket 53 are located on opposite sides of the circumferential flexible gasket 51. The circumferential flexible gasket 51 is sealed to the inner wall 11 of the inflatable pool body 1. Optionally, the circumferential flexible gasket 51 is high-frequency welded to the inner wall 11 of the inflatable pool body 1, and at the position where the pipe socket 5 is connected, the outer wall 12 of the inflatable pool body 1 is recessed inward and is connected to the inner wall 11 to form the recessed cavity 103. Optionally, the outer wall 12 is connected to inner wall 11 by means of bonding or high-frequency welding. The material of the circumferential flexible gasket 51 may be the same as that of the inner wall 11 and the outer wall 12, such as a PVC material. The circumferential flexible gasket 51 is optionally formed on the pipe socket 5 by means of integral injection molding.

As shown in combination with FIGS. 2*a* and 2*b*, after the circumferential flexible gasket 51 and the inner wall 11 are connected in a sealed manner, the inner pipe socket 52 is located in the water storage space 101, the outer pipe socket 53 is located in the cavity 103, and the outer pipe socket 53 comprises a plug-in portion 531 and a separable locking portion 532. The plug-in portion 531 comprises an annular plug-in groove 533 shaped and sized to enable insertion of the pool body connecting pipe 31 therein, and the locking portion 532 is engaged with an outer periphery of the plug-in portion 531. In particular, the plug-in portion 531 comprises an annular inner flange 5311 and an annular outer flange 5312, and the annular plug-in groove 533 is formed between the inner flange 5311 and the outer flange 5312. Further, in order to ensure robust connection between the pool body connecting pipe 31 and the pipe socket 5, after a first end 311 of the pool body connecting pipe 31 is inserted into the annular plug-in groove 533, the locking portion 532 is engaged with the outer periphery of the plug-in portion 531 to lock the pool body connecting pipe 31, such that the pool body connecting pipe may not easily be disengaged from the annular plug-in groove 533. More particularly, the outer flange 5312, on its outer periphery, is provided with a first external thread 534, and the locking portion 532 is then provided with a first internal thread 535 engaged with the first external thread 534.

The end of the locking portion 532 facing the pool body connecting pipe 31 (see the orientation shown in FIGS. 4*a* and 4*b*) may be provided with an inwardly extending lip 5321, forming a constriction, and the constriction may further lock the pool body connecting pipe 31 to the pipe socket 5.

The inner pipe socket 52 of the pipe socket 5 is optionally provided with an engaging portion 521 located in the water storage space 101 and may be configured to connect to a decorative member (not shown). The engaging portion is optionally in the form of an inner internal thread. The decorative member is, for example, a component covering a connection port in the water storage space 101 and providing decoration. In addition, the decorative member may filter foreign matter, preventing it from entering the connecting pipe 3.

Figure 4A:
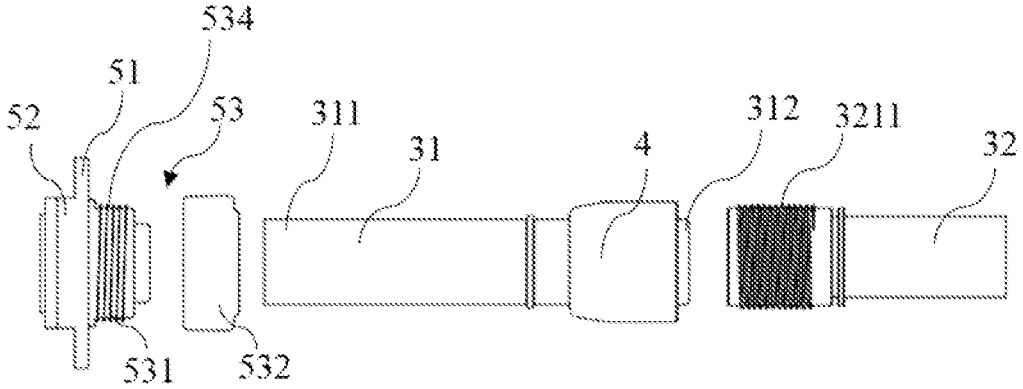
FIG. 4*a* is a schematic diagram of the various connecting pipes prior to connection, according to an example embodiment.

As shown in combination with FIGS. 4*a* to 4*b*, the pipe connector 4 connects the pool body connecting pipe 31 and the connector end 321 of the pump connecting pipe 32. The pool body connecting pipe 31 has a first end 311 connected to the pipe socket 5, and a second end 312 inserted into the pump connecting pipe 32 and sealed by a seal ring 6. The pipe connector 4 is shaped and sized such that is can be sleeved on the outer periphery of the pool body connecting pipe 31 at the first end 311, and an outer surface of the second end 312 of the pool body connecting pipe 31 is provided with a first limiting portion 3101 which may restrict the pipe connector 4 from moving out of the second end 312. The diameter of an end 41 of the pipe connector 4 close to the pipe socket 5 may be less than that of the other end 42 of the pipe connector 4 close to the pump connecting pipe 32, and the first limiting portion 3101 on the pool body connecting pipe 31 may be larger than the diameter of the end 41 of the pipe connector 4 close to the pipe socket 5, such that the end 41 of the pipe connector 4 close to the pipe socket 5 is blocked by the first limiting portion 3101 when reaching the first limiting portion 3101. Optionally, the first limiting portion 3101 is an annular limiting portion and is integrally formed on an outer surface of the pool body connecting pipe 31.

The pipe connector 4 may be prevented from slipping out of the first end 311 after the pipe connector is sleeved on the pool body connecting pipe 31. The pool body connecting pipe 31 may further comprise a second limiting portion 3102, the second limiting portion 3102 being closer to the pipe socket 5 than the first limiting portion 3101 and used for restricting the pipe connector 4 form moving out of the first end 311. The second limiting portion 3102 may be separable from the pool body connecting pipe 31, that is, before the pipe connector 4 is sleeved on the pool body connecting pipe 31, the second limiting portion 3102 may be removed from the pool body connecting pipe 31, and after the pipe connector 4 reaches a desired position, the second limiting portion 3102 (optionally an annular rubber ring) may be mounted in an annular groove in the outer surface of the pool body connecting pipe 31, so as to restrict the end 41 of the pipe connector 4 close to the pipe socket 5 between the second limiting portion 3102 and the first limiting portion 3101.

An engaging groove 401 for receiving the connector end 321 of the pump connecting pipe 32 may be formed between an inner surface of the pipe connector 4 and the outer surface of the pool body connecting pipe 31. At least part of the inner surface of the pipe connector 4 may be provided with a second internal thread 43, and the outer periphery of the connector end 321 of the pump connecting pipe 32 may be provided with a second external thread 3211 engaged with the second internal thread 43. When the second end 312 of the pool body connecting pipe 31 is inserted into the connector end 321 of the pump connecting pipe 32, the pipe connector 4 may be rotated such that a wall of the connector end 321 enters into the engaging groove 401 and locks the pool body connecting pipe 31 and the pump connecting pipe 32.

As shown in FIGS. 3*a* and 3*b* and 4*a* and 4*b*, the water storage space 101 in the inflatable pool body 1 is in communication with the pump device 2 by means of the pipe socket 5, the pool body connecting pipe 31, the pipe connector 4, and the pump connecting pipe 32.

Figure 6:
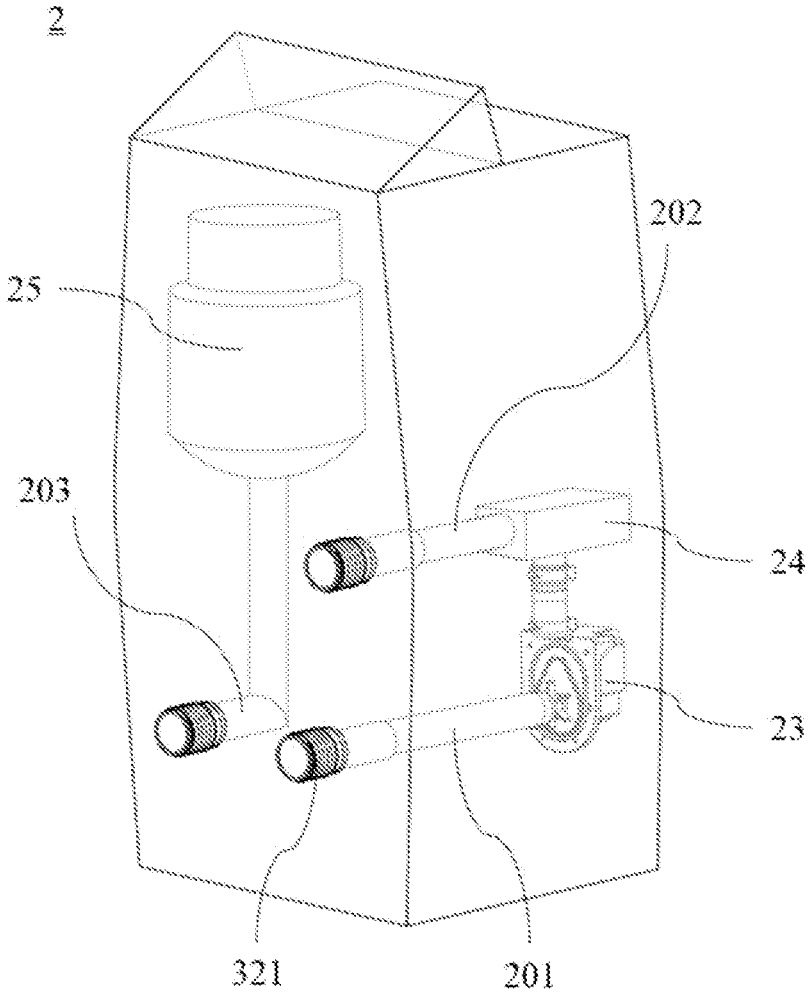
FIG. 6 is a schematic diagram of an inside of the pump device shown in FIG. 5.

As previously mentioned, the connector end 321 of the pump connecting pipe 32 protrudes from the housing 21 of the pump device 2. Further, as shown in FIG. 5, the pump device 2 comprises a control panel 22 arranged on the housing, wherein the control panel 22 is optionally arranged on an upper portion of the housing 21 to facilitate operation and control by a user. As shown in FIG. 6, the pump connecting pipe 32 comprises at least a water inlet pipe 201 and a water outlet pipe 202, and a filter pump 23 and a heater 24 are sequentially arranged between an outlet of the water inlet pipe 201 and an inlet of the water outlet pipe 202, wherein the filter pump 23 is configured to filter impurities in the water received from the inflatable pool body 1, and the heater 24 is configured to adjust the water temperature. The pump device 2 shown in FIGS. 5 to 6 may further comprise a venting pipe 203 connected to an air pump 25. Air pumped into the water in the inflatable pool body 1 may provide a massage function. The venting pipe 203 may be connected to an inflation valve (not shown) of the inflatable pool body 1 to enable inflation therethrough.

The inflatable pool body 1 may comprise at least two separate cavities adapted to the pump connecting pipe 32 comprising at least the water inlet pipe 201 and the water outlet pipe 202, such that the number of the pool body connecting pipes is adapted to that of the pump connecting pipes. As the example embodiment shown in FIG. 7, portions of the outer wall 12 of the inflatable pool body 1 is recessed inward and is connected to the inner wall 11 to form three recessed cavities 103 for accommodating the water inlet pipe 201, the water outlet pipe 202, and the venting pipe 203, respectively. Correspondingly, the pool body connecting pipe 31 comprises separate pool body connecting pipes respectively connected to the water inlet pipe 201, the water outlet pipe 202, and the exhaust pipe 203.

When the inflatable pool body 1 is connected to the pump device 2, various pipe sockets 5 are connected to the inner wall 11 of the inflatable pool body 1 by means of the circumferential flexible gaskets 51 in a sealed manner; one of the pipe connectors 4 is first sleeved on each of the pool body connecting pipes 31, and the second limiting portion 3102 is may then be mounted on the pool body connecting pipe 31 in place; the locking portion 532 of the pipe socket 5 is first sleeved on the pool body connecting pipe 31, and the first end 311 of the pool body connecting pipe 31 is then inserted into the annular plug-in groove 533 before the locking portion 532 is locked; and finally, the second end 312 of the pool body connecting pipe 31 is inserted into the connector end 321 of the pump connecting pipe 32, and the pipe connector 4 is then locked. After the pool body connecting pipe 31 is connected to the pump connecting pipe 32, the inflatable pool body 1 is inflated, that is, the installation of the inflatable pool 10 is realized.

For disassembling, the inflatable pool body 1 may be deflated first, and then the pool body connecting pipe 31 may be detached from the pump connecting pipe 32.

According to an example embodiment, the pool body connecting pipe 31 may be a flexible pipe, facilitating the plug-in of two ends of the pool body connecting pipe 31.

According to one or more example embodiments, an inflatable pool may cover a small area, may avoid the exposure of the connecting pipes, and may provide an intuitive aesthetic feeling to the user. Various pipelines may be easy to connect and disassembly and maintenance may be facilitated. During use, the pipeline connection may be stable, and there may be limited or no water leakage. In addition, the control panel of the pump device may be close enough to touch, facilitating adjusting functions desired by the user.

It may be understood that example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable pool, comprising:

an inflatable pool body comprising:

an inner wall, an outer wall, and a bottom wall, the inner wall and the bottom wall defining a water storage space, and the inner wall and the outer wall forming an inflatable chamber therebetween, wherein a cavity is defined between the inner wall and the outer wall;

a pump device;

a pool body connecting pipe comprising an inner end in communication with the water storage space and an outer end disposed within the cavity;

a pump connecting pipe comprising an outer end connected to the pump device, and an inner end comprising a connector detachably connected to the outer end of the pool body connecting pipe; wherein a junction between the pool body connecting pipe and the pump connecting pipe is disclosed within the cavity; and a pipe connector connected between the outer end of the pool body connecting pipe and the connector of the pump connecting pipe;

wherein the inner end of the pool body connecting pipe is connected to the inner wall of the inflatable pool body and in communication with the water storage space via a pipe socket;

wherein the pipe socket comprises:

an inner pipe socket, an outer pipe socket, and a circumferential flexible gasket disposed between the inner pipe socket and the outer pipe socket and sealed to the inner wall of the inflatable pool body, wherein the outer pipe socket is disposed within the cavity and comprises: a plug-in portion comprising an annular plug-in groove fitting the pool body connecting pipe therein, and a locking portion engaged with an outer periphery of the plug-in portion.

2. The inflatable pool according to claim 1, wherein the inner pipe socket comprises an engaging portion disposed within the water storage space.

3. The inflatable pool according to claim 1, wherein the plug-in portion of the outer pipe socket comprises:

an annular inner flange comprising, on a periphery thereof, a first external thread configured to engage with a first internal thread disposed on the locking portion; and an annular outer flange;

the annular plug-in groove being formed between the inner flange and the outer flange.

4. The inflatable pool according to claim 3, wherein an inner end of the locking portion comprises an inwardly extending lip.

5. The inflatable pool according to claim 1, wherein:

the pump device comprises a control panel disposed on a housing;

the pump connecting pipe extends into the housing of the pump device and comprises, within the housing of the pump device, a water inlet pipe, and a water outlet pipe; and the pump device further comprises a filter pump and a heater sequentially arranged between an outlet of the water inlet pipe and an inlet of the water outlet pipe.

6. The inflatable pool according to claim 5, wherein the cavity comprises a first cavity and a second cavity.

7. An inflatable pool, comprising:

an inflatable pool body comprising:

an inner wall, an outer wall, and a bottom wall, the inner wall and the bottom wall defining a water storage space, and the inner wall and the outer wall forming an inflatable chamber therebetween, wherein a cavity is defined between the inner wall and the outer wall;

a pump device;

a pool body connecting pipe comprising an inner end in communication with the water storage space and an outer end disposed within the cavity;

a pump connecting pipe comprising an outer end connected to the pump device, and an inner end comprising a connector detachably connected to the outer end of the pool body connecting pipe; wherein a junction between the pool body connecting pipe and the pump connecting pipe is disposed within the cavity, and a pipe connector connected between the outer end of the pool body connecting pipe and the connector of the pump connecting pipe;

wherein the inner end of the pool body connecting pipe is connected to the inner wall of the inflatable pool body and in communication with the water storage space via a pipe socket;

wherein the inner end of the pool body connecting pipe is connected to the pipe socket, and the outer end of the pool body connecting is inserted into the connector end of the pump connecting pipe and sealed by a seal ring;

wherein the pipe connector is configured to be sleeved on the outer periphery of the outer end of the pool body connecting pipe, the outer periphery of the outer end of the pool body connecting pipe comprising a first limiting portion configured to restrict movement of the pipe connector;

wherein an inner diameter of the inner end of the pipe connector is less than an inner diameter of the outer end of the pipe connector;

wherein the connector of the inner end of the pump connecting pipe is inserted between an inner circumferential surface of the outer end of the pipe connector and an outer circumferential surface of the outer end of the pool body connecting pipe, and wherein the inner surface circumferential of the pipe connector comprises a second internal thread, and the outer circumferential surface of the connector of the pump connecting pipe comprises a second external thread configured to engage with the second internal thread.

8. The inflatable pool according to claim 7, wherein the pool body connecting pipe further comprises a second limiting portion configured to restrict movement of the pipe connector, the second limiting portion being separable from the pool body connecting pipe.

* * * * *